US005540435A

United States Patent [19]

Kawasaki

[11] Patent Number: 5,540,435

[45] Date of Patent: Jul. 30, 1996

[54] GOLF CLUBS

[76] Inventor: Jiro Kawasaki, 19-9 Shin-ohashi 2-chome, Koto-ku, Tokyo, Japan

[21] Appl. No.: 950,878

[22] Filed: Sep. 22, 1992

[30] Foreign Application Priority Data

Sep. 25, 1991 [JP] Japan ..... 3-271903

[51] Int. Cl.[6] ..... A63B 53/02

[52] U.S. Cl. ..... 473/309; 473/312

[58] Field of Search ..... 273/80.1, 80.2, 273/80.3, 80.4, 80.5, 80.6, 80.7, 80.8, 80.9, 77 R, 167 R

[56] References Cited

U.S. PATENT DOCUMENTS

| | | | |
|---|---|---|---|
| 947,822 | 2/1910 | Kilgour | 273/80.3 |
| 1,643,754 | 9/1927 | Sleith | 273/80.3 |
| 1,690,266 | 11/1928 | Barrett | 273/80.8 |
| 1,980,031 | 11/1934 | Brading | 273/80.6 |
| 1,994,149 | 3/1935 | Root | 273/80.2 |
| 3,170,691 | 2/1965 | Pritchard | 273/80.7 |
| 5,039,098 | 8/1991 | Pelz | 273/80.8 X |

FOREIGN PATENT DOCUMENTS

| | | | |
|---|---|---|---|
| 287497 | 10/1928 | United Kingdom | 273/80.8 |
| 353661 | 7/1931 | United Kingdom | 273/80.8 |
| 362486 | 11/1931 | United Kingdom | 273/80.7 |
| 377026 | 7/1932 | United Kingdom | 273/80.8 |

*Primary Examiner*—Sebastiano Passaniti

*Attorney, Agent, or Firm*—Anderson Kill Olick & Oshinsky, P.C.

[57] ABSTRACT

A golf club formed of a hollow golf shaft, a golf head having a through hole for receiving the hollow golf shaft, and an engaging member for securing the golf shaft in the golf head, and which is fixedly secured to an end surface of the golf shaft, and has a cross-sectional shape, which progressively changes from a non-circular to a circular, and a threaded hole formed at an end face remote from the golf shaft for receiving a bolt that fixes the engaging member with the golf shaft in the golf head.

5 Claims, 2 Drawing Sheets

GOLF CLUBS

BACKGROUND OF THE INVENTION

1. Field of the Invention

This invention relates to a golf club, which can be selected in accordance with various conditions such as a golfer's physical constitution, physical condition and ball line.

2. Description of the Prior Art

Conventional golf clubs are so formed that individual club head material, loft angle, face direction, shaft material, and hardness are unchangeable for each club, and therefore, possibilities for altering the properties of golf clubs to be used by golfers with different physical conditions in general, are limited to that how they may fix lead plates to their club heads at most.

Various factors such as technical advancement of aging golfers, influence the requirements the golfers put to the clubs, and the time arrives when old clubs are not able to satisfy the new requirements. As a result, the golfers throw aside their clubs to which they have been accustomed and replace their old clubs with new ones.

Accordingly, the object of the invention is a golf club, the properties of which can be altered by the replacement of the constituting parts of the golf club in use.

SUMMARY OF THE INVENTION

According to the invention, there is provided a golf club characterized in that an engaging piece, intergrally formed with a shaft rod which is inserted into and fixed to a hollow cylindrical club shaft, connects the club shaft with the club head. The engaging piece has a shape, which changes from a non-circular to a circular and which corresponds to the shape of a through hole provided in a neck portion of the club head. The club shaft is connected to the club head with a bolt screwed into a screw hole formed in the end surface of the engaging piece when the engaging piece is inserted into the through hole. According to the present invention, the non-circular shape of the engaging piece and of the through hole is hexagonal.

According to the present invention, a golf club, which is most suitable for a golfer, is assembled by untightening the connecting bolt, separating the club shaft from the club head, and selectively combining the material and/or the hardness of the club shaft and the material and/or the soft angle of the club head with one another.

BRIEF DESCRIPTION OF THE DRAWINGS

The detailed description of the present invention will be given with reference to a preferred embodiment shown in the attached drawing, wherein.

DETAILED DESCRIPTION OF THE PREFERRED EMBODIMENT

Figure 1:
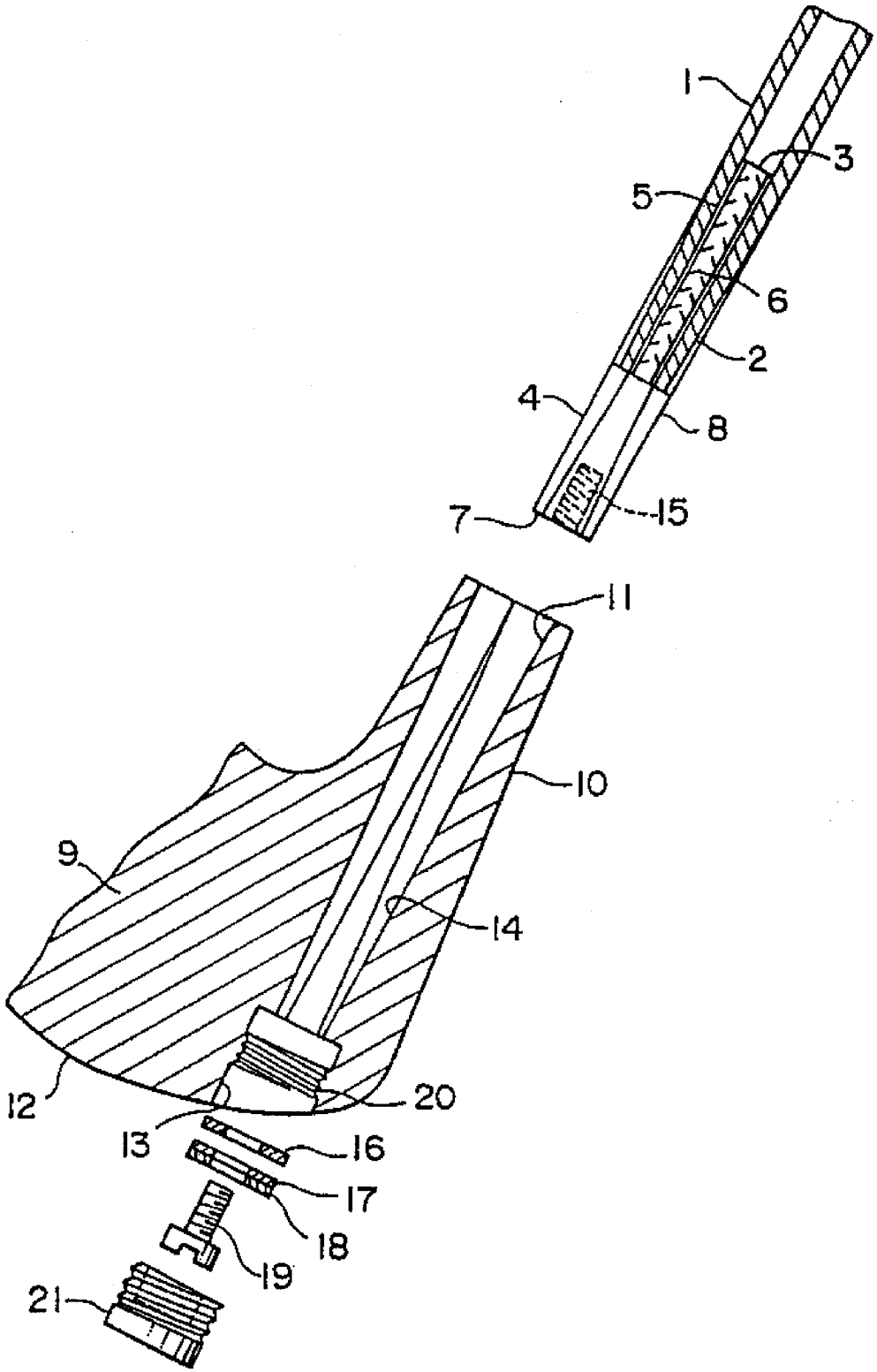
FIG. 1 is an exploded view of a golf club according to the present invention.

First, in FIG. 1, reference numeral 1 indicates a hollow and cylindrical club shaft having a tapering shape toward the golf head, and is not different from conventional golf clubs where a grip is formed at a base thereof (not shown).

Figure 2:
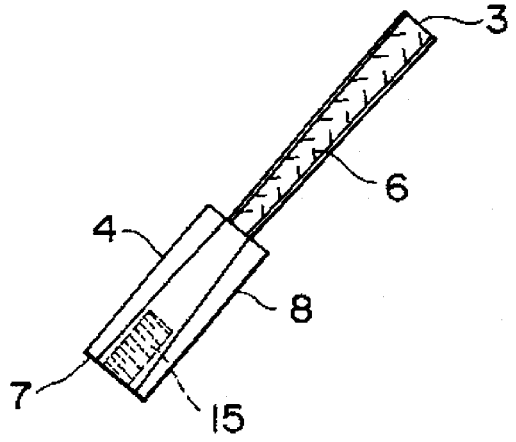
FIG. 2 is a view showing a portion of the golf club of FIG. 1.

A tapering portion 2 of the club shaft 1 is assembled with an engaging piece 4 integrally formed with a shaft rod 3 as shown in FIG. 2, and the assembly of the engaging piece 4 with the portion 2 is carried out by packing an adhesive 5 between the shaft rod 3 and the internal wall of the portion 2 of the club shaft 1 so that they adhere to each other. In order to increase the adhesive strength in this case, nicks 6 are formed on the external circumference of the shaft rod 3.

An end portion 7 of the engaging piece 4 has a non-circular cross-section, e.g., a hexagonal shape which changes progressively to a circular shape. The portion of the club shaft 1, connectable with the engaging piece 4, is covered with a resin coating the shape of which continues the change from the above-mentioned non-circular shape into a circular shape. The combination of the resin-coated portion of the shaft 1 and the engaging piece 4 defines an engagement portion 8.

On the other hand, a through hole 11 is provided in a neck portion 10 of a club head 9, and an engagement portion 14 matching the engagement portion 8 is formed therein. The hole 11 includes an enlarged portion 13 formed at a sole surface 12 of the club head 9. The portion of the hole 11 adjacent to the enlarged portion 13 has a non-circular cross-sectional shape corresponding to the shape of the engaging piece 4.

Figure 3:
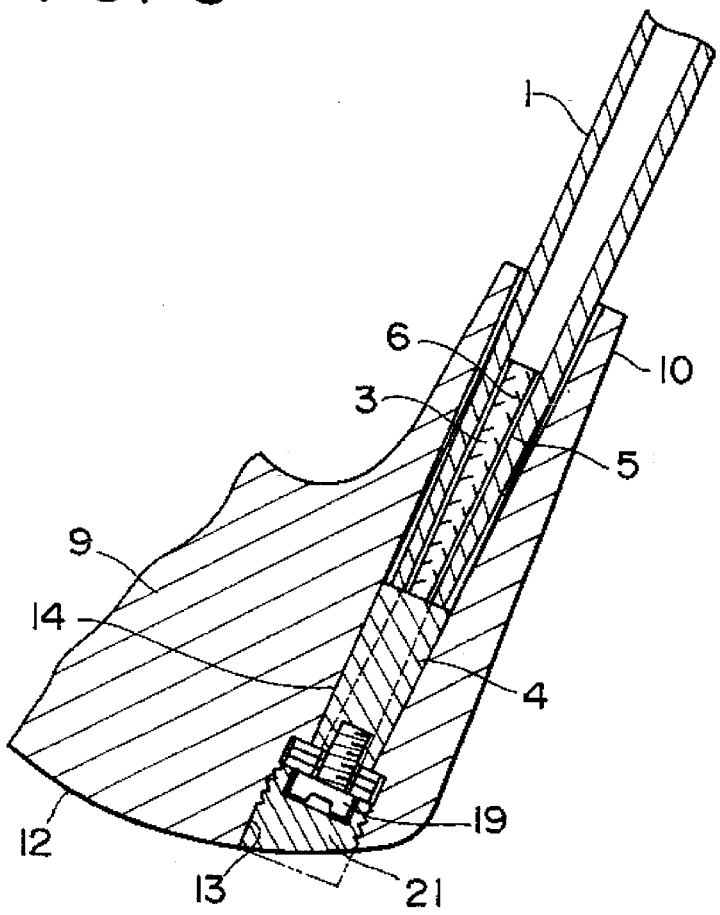
FIG. 3 is a partial view of the golf club in an assembled condition.

The club shaft 1 and the club head 9 are connected to each other so that a relative rotation in a circumferential direction therebetween is prevented when the engaging piece 4 is inserted into the through hole 11, and the engagement portions 8 and 14 engage each other as shown in FIG. 3.

To secure the shaft 1 with the head 9, a bolt 19 is screwed into a screw hole 15 provided in the engaging piece 4 through a packing 16 and washers 17 and 18. The bolt 19 is hidden within the enlarged hole portion 13. At the same time, a resin bolt 21 is screwed into a female screw 20 formed on the internal wall of the enlarged portion 13, and a portion projecting from the sole surface 12 of this screw bolt 21 is shaved down to provide a smooth surface.

The commercially available club heads available at present are wooden heads (persimmon tree), aluminum heads (metal), stainless steel heads (metal), titanium heads (metal), and plastic heads (resin). As for the materials of club shafts, steel (for general purposes), black shaft (carbon), boron (carbon+tungsten), Ti (titanium), aluminum (aluminum alloy), and stainless steel (steel+chromium) are used.

The face direction of a club head may be formed to generate ball flights such as hook, slight hook, straight, slight slice and slice, and it defines the loft angle of the head, and several kinds are available for each class ranging from No. 1 (driver) to No. 5 (creak), respectively.

Furthermore, with respect to the hardness of club shafts, there are ten kinds of hardnesses such as L, LA, A, AR, R, RS, S, SX, X and XX respectively.

The selection of the most suitable golf club to an individual golfer of a different sex, age, physical capabilities, physical condition, or ball line, is made by altering the combination of the materials of a club head and a club shaft, the face direction of the club head, the loft angle and the hardness of the club shaft as described above.

The present invention enables to combine a most suitable club head with the personality of each golfer whose individuality is granted as a matter of course with a club shaft. With conventional golf clubs, the purchase of a new golf club is required when the change in its characteristics is desired, since the changing of the club head is not possible. The present invention provides an economical advantage and, at the same time, makes it easy to reach a most suitable golf club for an individual golfer.

I claim:

1. A golf club, comprising:

a hollow golf shaft;

a golf head having a through hole for receiving said hollow golf shaft; and means for securing said golf shaft in said golf head, said securing means comprising:

an engaging member fixedly secured to an end surface of said golf shaft and having a cross-sectional shape, which progressively changes from a non-circular to a circular, and a threaded hole formed at an end face remote from said golf shaft, and a bolt extending into said through hole of said golf head at a sole surface thereof and cooperating with said threaded hole of said engaging member for securing said golf shaft to said golf head, said through hole of said golf head having a portion with a shape complementary to the shape of said engaging member for preventing relative rotation between said golf head and said golf shaft.

2. A golf club as set forth in claim 1, wherein the engaging member includes a rod extending from an end face of said engaging member adjacent to said golf shaft, and into said hollow golf shaft, for connecting said golf shaft with said engaging member.

3. A golf club as set forth in claim 2, wherein said rod is connected with said golf shaft by adhesive.

4. A golf club as set forth in claim 1, wherein the non-circular cross-sectional shape of said engaging member is a hexagonal shape.

5. A golf club as set forth in claim 1, wherein said golf shaft has a tapering end portion adjacent to said engaging member, and which is covered with a resin layer which forms a transition region between another of said end faces of said engaging member and a cylindrical portion of said golf shaft, said transition region having a shape which continues the progressive change of the shape of said engaging member from non-circular to circular.

* * * * *